US006162152A

United States Patent [19]

Kuo

[11] Patent Number: 6,162,152

[45] Date of Patent: Dec. 19, 2000

[54] RESISTANCE CONTROL DEVICE FOR A TRAINING APPLIANCE

[75] Inventor: Chun-Chang Kuo, Tainan, Taiwan

[73] Assignee: Tonic Fitness Technology, Inc., Tainan Hsien, Taiwan

[21] Appl. No.: 09/438,705

[22] Filed: Nov. 11, 1999

[30] Foreign Application Priority Data

Apr. 21, 1999 [TW] Taiwan ..... 88206180

[51] Int. Cl.[7] ..... A63B 22/06

[52] U.S. Cl. ..... 482/63; 482/57; 482/61; 482/65; 482/903

[58] Field of Search ..... 482/57, 58, 60, 482/61, 63, 65, 903, 64

[56] References Cited

U.S. PATENT DOCUMENTS

| | | | |
|---|---|---|---|
| 5,031,901 | 7/1991 | Saarinen | 272/73 |
| 5,466,203 | 11/1995 | Chen | 482/63 |
| 5,492,513 | 2/1996 | Wang | 482/4 |

*Primary Examiner*—Jerome W. Donnelly
*Assistant Examiner*—Tam Nguyen
*Attorney, Agent, or Firm*—Pro-Techtor International Services

[57] ABSTRACT

A resistance control device for a training appliance includes a resist wheel fixed on the training appliance, and a magnet base adjustable in the distance between the resist wheel and having a plurality of magnets. A right end of the magnet base is pivotally connected to a fix base fixed with the training appliance, and a left end remaining free to move up and down and having a lateral rod. Further, an eccentric block is located at one side of the lateral rod, having a center shaft hole for fixing a shaft rotated by a drive source and a long curved slot for the lateral rod to fit in and move along. The distance between every point of the slot and the center shaft hole is decided by a calculation formula F=Ca×S all different. When the eccentric block is moved by the drive source, its moved distance causes the lateral rod also move for the related distance in the slot to rise or lower, altering the distance between the magnet base and the resist wheel so as to control resistance of the resist wheel against the magnet base. So this device is handy, saving time and labor, and adjusting resistance is precise.

4 Claims, 8 Drawing Sheets

RESISTANCE CONTROL DEVICE FOR A TRAINING APPLIANCE

BACKGROUND OF THE INVENTION

This invention relates to a resistance control device for a training appliance, particularly to one simple to assemble, of low cost, and its adjustment of resistance accurate.

Conventional resistance control devices are generally classified into two kinds, one contactable and the other non-contactable. The former is easily worn off, unpopular for consumers.

Conventional non-contactable one is disclosed in a Taiwan Utility Model entitled "Magnet Control Device For a Training Bike", Application No. 83212071 (as shown in the copy enclosed). This magnet control device includes a resist wheel, a fix base fixed on a bottom base, a magnet means connected to the fix base to move up and down, a magnet base with several magnets located under the magnet means, and a motor fixed at one side of the fix base, a micro switch contact the spherical edge of a position wheel rotated by the motor. The feature is, referring to FIGS. 4–7 in the copy, that the magnet means 40 has a pair of ears 45 at preset location of the fix base 30; a transmitting mechanism has an eccentric wheel 67, and a cam 60 fixed on its outer annular edge and pivotally connected to the ears 45. The eccentric wheel 67 has a hollow post 69 near the outer annular edge and protruding from one side to the other side of the eccentric wheel 67, having one end screwed on the eccentric output shaft 51 of the motor 50 and the other end fixed with the position wheel 70.

The conventional magnet control device, as shown in FIG. 4, consists of many components, with their assemblage complicated to take time to result in high cost.

SUMMARY OF THE INVENTION

The objective of the invention is to offer a resistance control device for a training appliance simple to assemble, of low cost, with control of brake resistance accurate, and of non-contact control device to enhance competitiveness in market.

The feature of the invention is a magnet base fixed beside a resist wheel of a training appliance, plural magnets on the magnet base, a first end of the magnet base pivotally connected to a fix base fixed on the training appliance and a second end being free to move up and down and having a lateral rod. Further, an eccentric block is located at one side of the lateral rod, having a center shaft hole for fixing a shaft rotated by a drive source, and a long curved slot for the lateral rod to fit in and move along therein. The distance between every point of the long curved slot is decided by a calculation formula, F (resistance)=$C_3$ (constant)×S (distance), all different, and calculating magnet resisting watts at every point in deciding the distance. When the eccentric block is moved by the drive source, the lateral rod moves along the slot according to the distance moved of the block, rising or lowering to alter the distance between the surfaces of the magnets and the resist wheel, adjusting resistance of the resist wheel against the magnet base.

BRIEF DESCRIPTION OF THE INVENTION

This invention will be better understood by referring to the accompanying drawings, wherein.

DETAILED DESCRIPTION OF THE PREFERRED EMBODIMENTS

Figure 1:
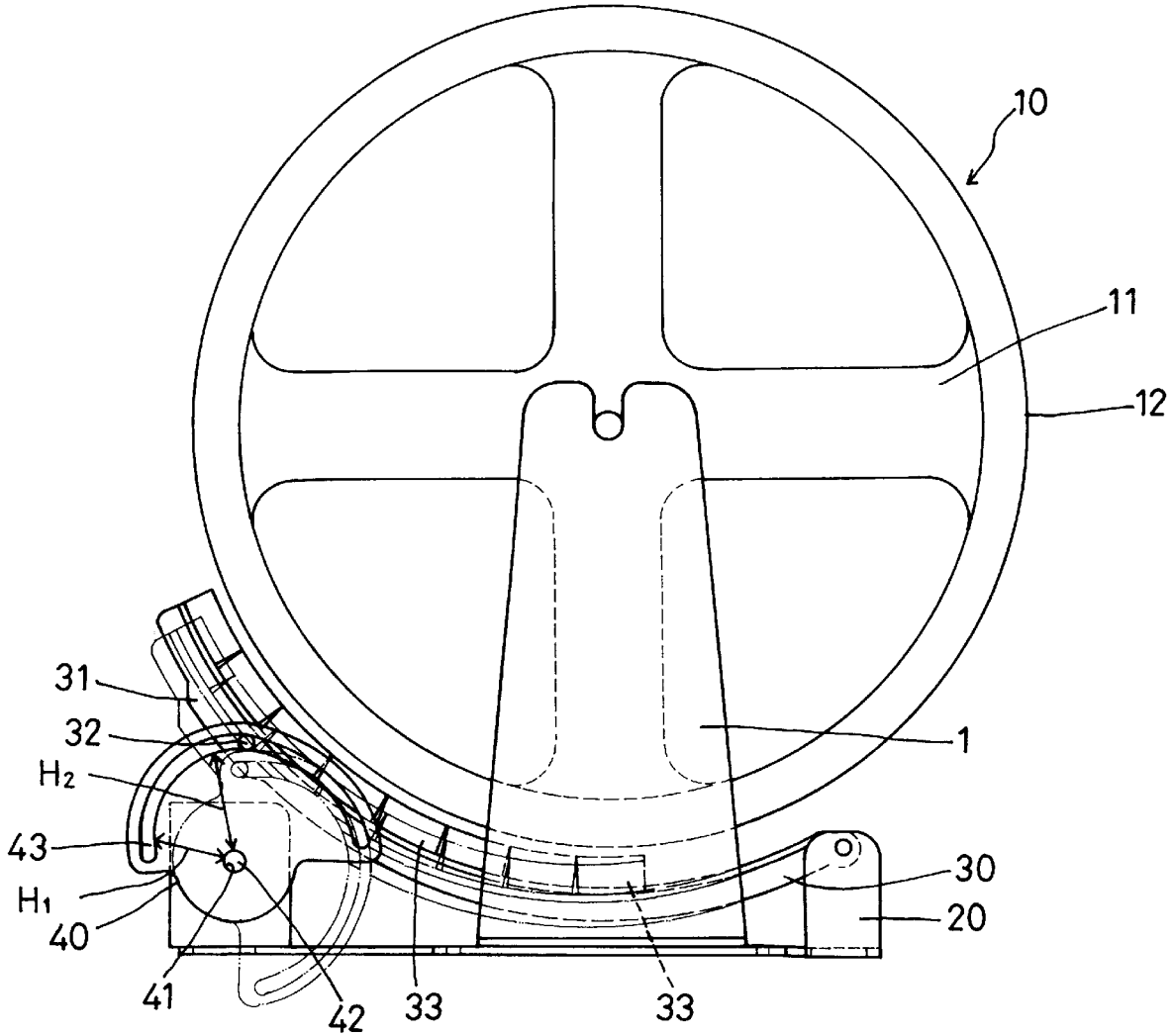
FIG. 1 is a front view of a first embodiment of a resistance control device for a training appliance in the present invention.

A first embodiment of a resistance control device for a training appliance in the present invention, as shown in FIG. 1, includes a resist wheel 10, a fix base 20, a magnet base 30, and an eccentric block 40 as main components combined together.

The resist wheel 10 is fixed on a frame of a training appliance body 1, able to be rotated, having a wheel body 11 of magnetical property to be attracted by a magnet, a spherical surface 12 of non-magnetical property not to be attracted by a magnet. The two sides of the resist wheel 10 is supported on the training appliance body 1, able to be rotated at the site.

The fix base 20 is fixed with the training appliance below the resist wheel 10, located at a proper distance from the lower surface of the resist wheel 10.

The magnet base 30 is provided to be located between the spherical surface 12 of the resist wheel 10 and the fix base 20, having the same curve as the spherical surface 12 and a right end pivotally connected to the fix base 20. The pivot point is located at one side of the center of the resist wheel 10, and the front end of the magnet base 30 is a free end 31, extending along the spherical surface 12 to the other side of the center of the resist wheel 10 and able to move up and down relative to the spherical surface 12. The free end 31 has a lateral rod 32 and a plurality of magnets 33 are arranged in a row continuously on the magnet base facing the spherical surface 12.

Figure 2:
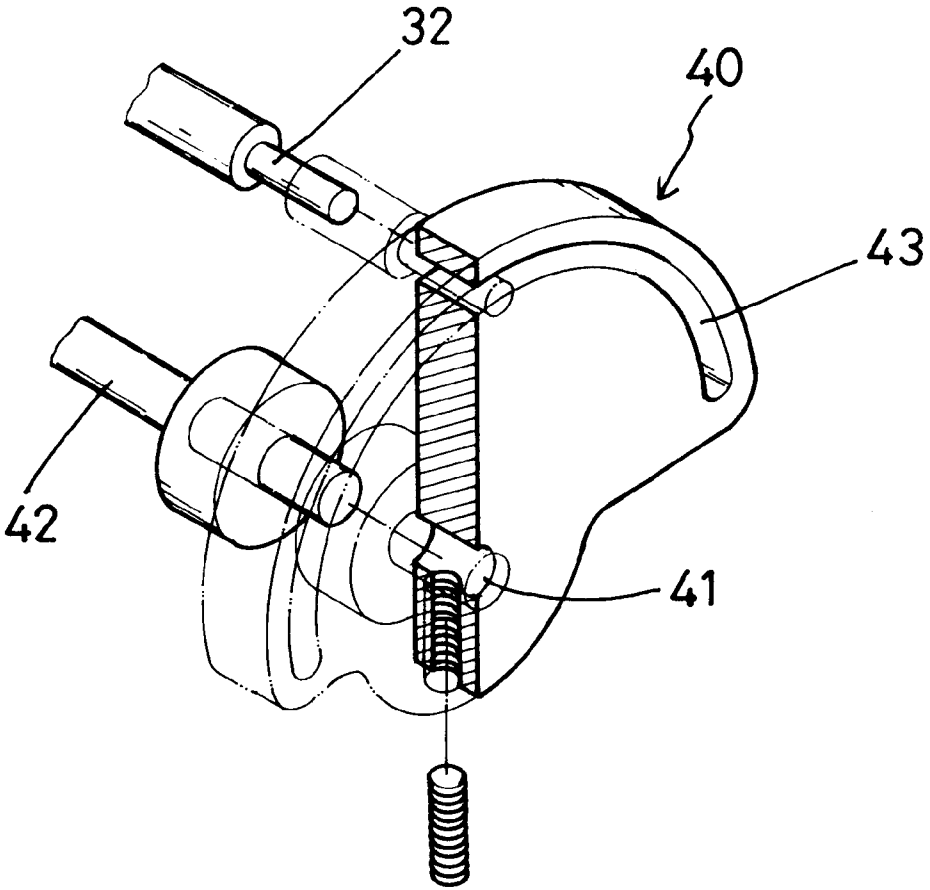
FIG. 2 is an eccentric block and related components in the first embodiment of a resistance control device in the present invention.

The eccentric block 40, also referring to FIG. 2, is located at one side of the lateral rod 32, having a center shaft hole 41 for a shaft 42 to pass through and fixed tightly therein and possible to be rotated by a drive source such as a motor with a speed reducer, to rotate eccentrically the eccentric block 40. Further, the eccentric block 40 has a long curved slot 43 for the lateral rod 32 to fit in and move along therein. The distance between every point of the slot 43 and the center shaft hole 41 is decided by a calculating formula, F (resistance)=$C_3$ (constant)×S (distance), all different from each other, for example, as shown in FIG. 1, $H_2$ is longer than $H_1$. Thus, the resistance produced by the magnets 33 against the resist wheel 10 at the contact Point of the lateral rod 32 with the slot 43 is preset when the eccentric wheel 40 is adjusted in in its angle.

When the eccentric wheel 40 is rotated by a drive source (as shown in dotted lines in FIG. 1), the lateral rod 32 is also moved accordingly to move up and down along the slot 43, altering synchronously the distance between the magnets 33 and the spherical surface 12 of the resist wheel 10. Therefore, the magnetic field produced by the magnet base 30 may be cut by the spherical surface 12 to let the wheel body 11 produce whirl current to control the resistance of the resist wheel, when a user pedals to rotate the resist wheel 10.

Figure 3:
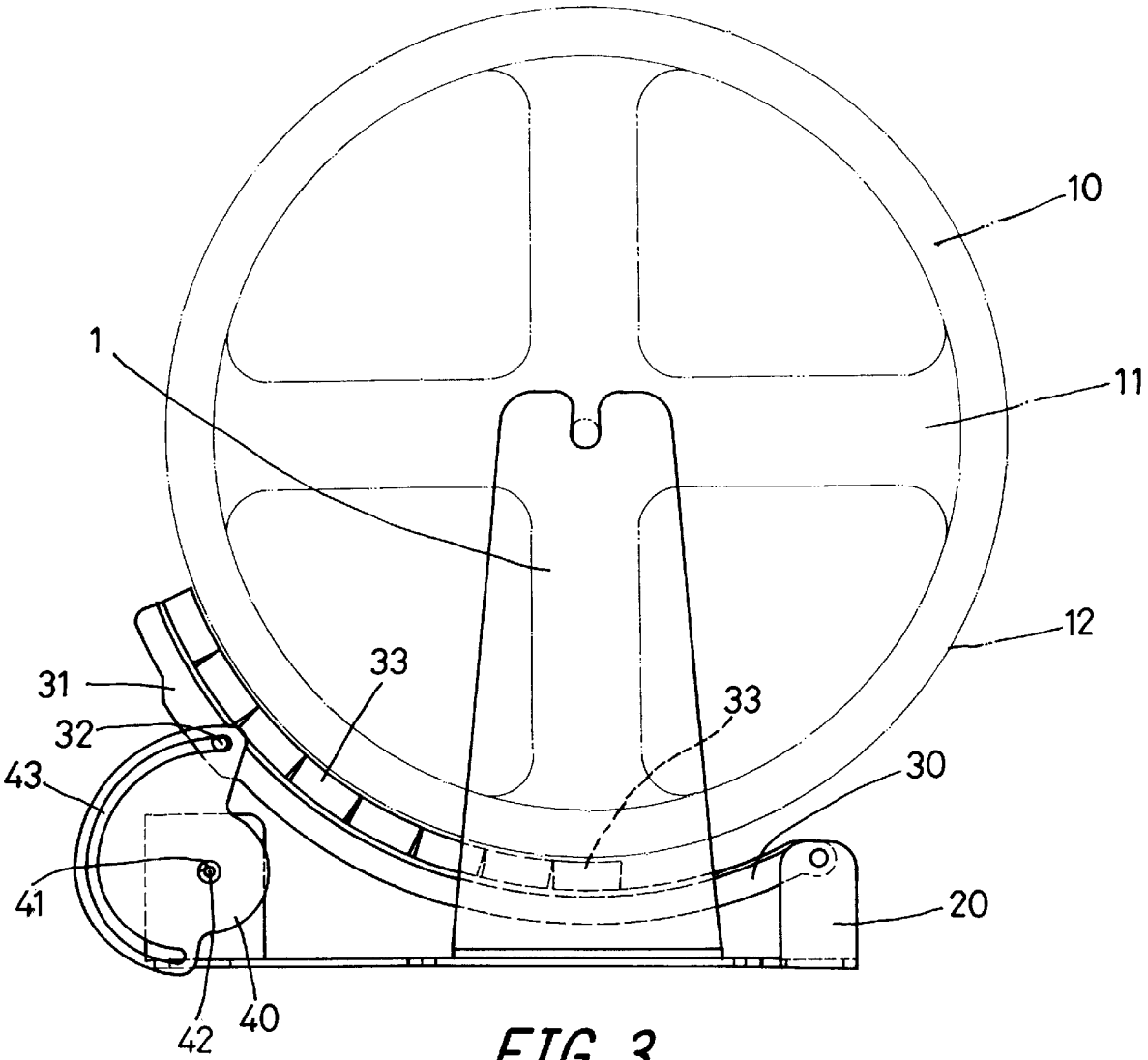
FIG. 3 is a front view of the resistance control device adjusted to the largest resistance in the present invention.
Figure 4:
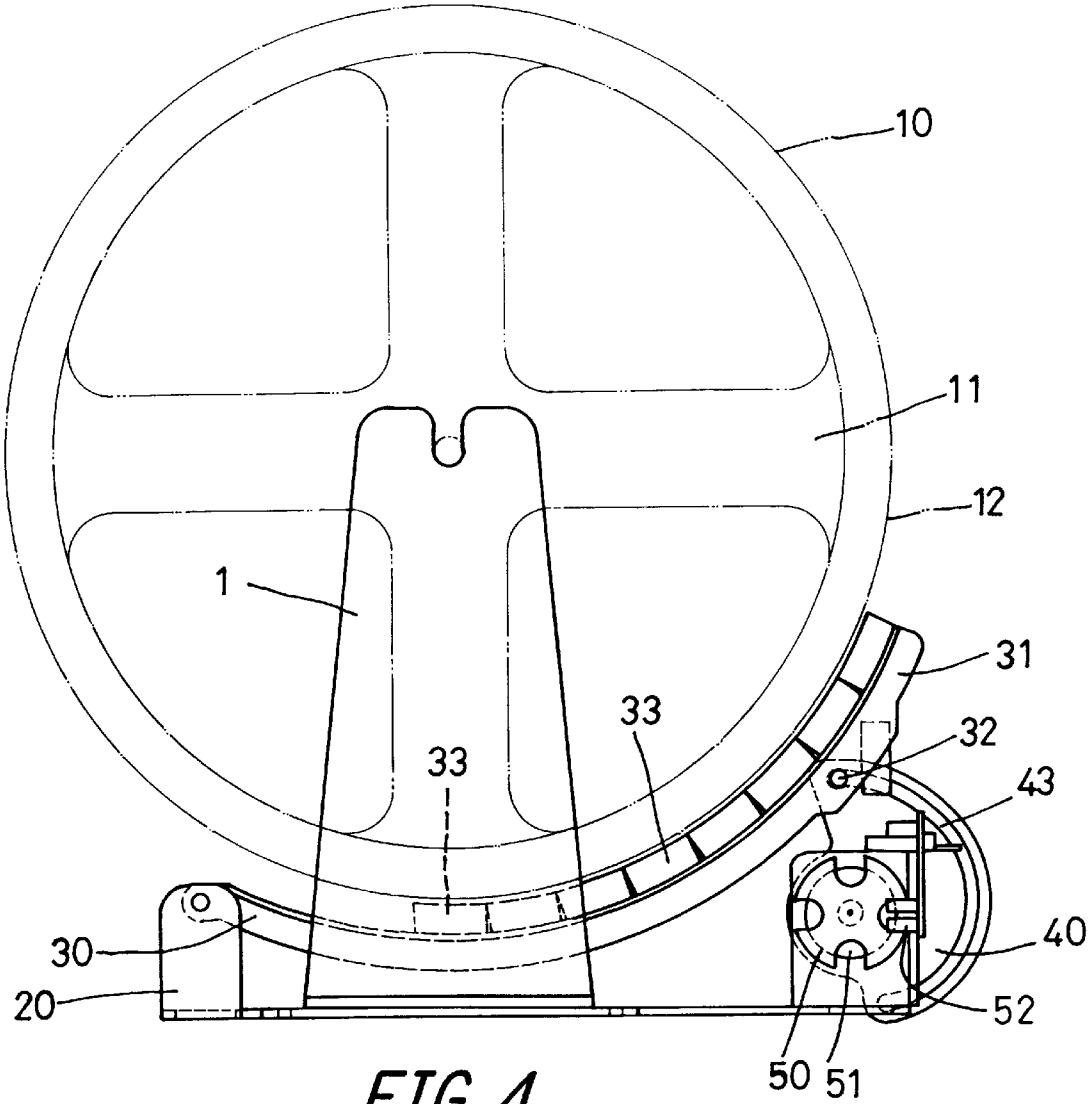
FIG. 4 is a rear view of the resistance control device adjusted to the largest resistance in the present invention.
Figure 7:
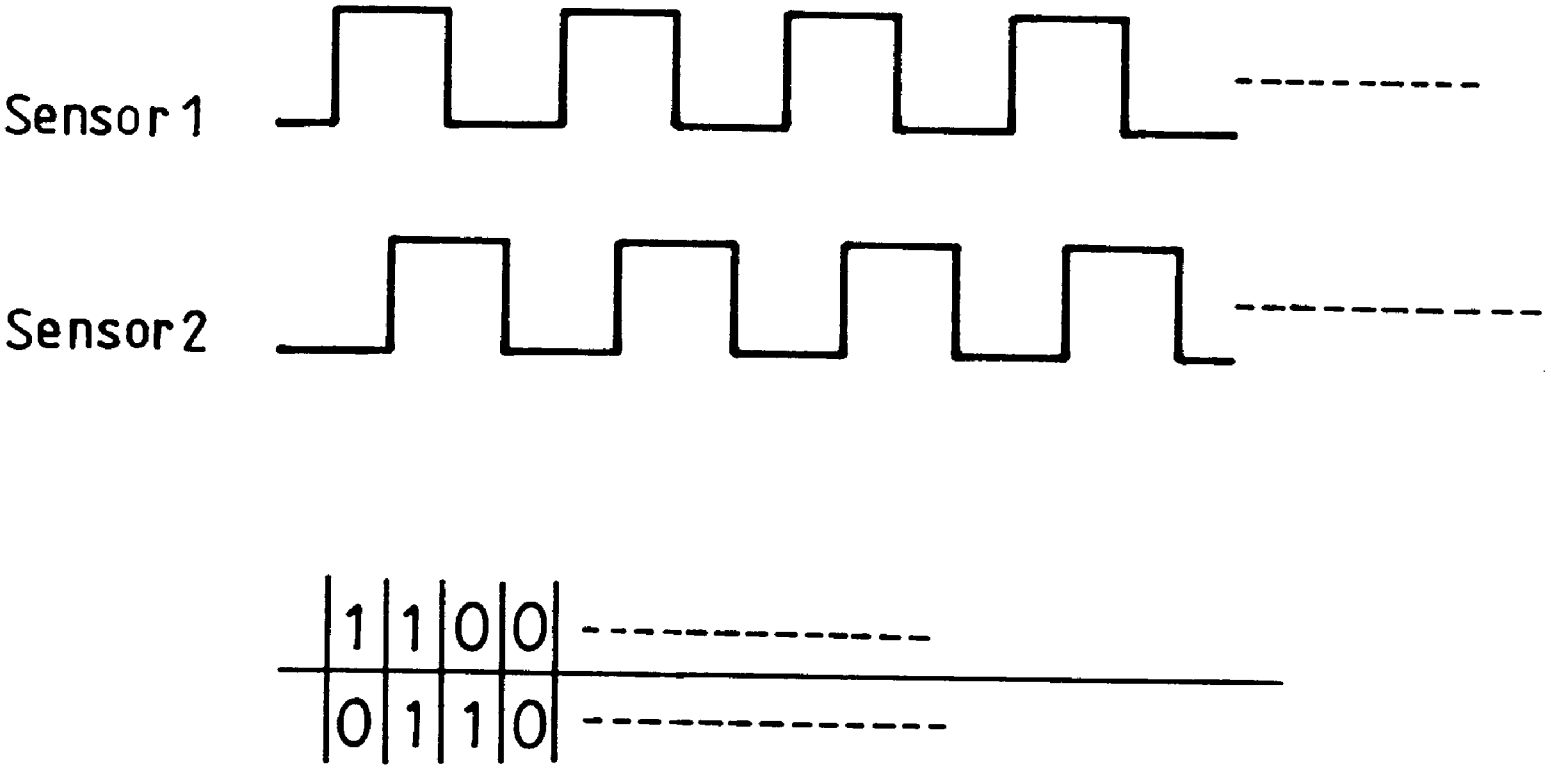
FIG. 7 is a graph of the pulse of two sensors in the present invention; and, FIG. 8 is a side view of a variable resistor in the present invention.

In adjusting the resistance of the resist wheel 10, it is in the largest resisting condition shown in FIG. 3, because the distance between the magnets 33 are positioned the nearest to the spherical surface 12 of the resist wheel 10. So as shown in FIG. 1, the resist wheel 10 is positioned in the weakest resisting condition, shown by the dotted line, as the magnets 33 are located the farthest from the spherical surface 12. In order to drive or stop the eccentric block 40, as shown in FIG. 4, a rotatable disc 50 is provided on the same shaft of the eccentric block 40, having four notches 51 on its outer edge in cross condition. Further two sensors 52 are provided to correspond to the notches 51 to send out output signals to control the drive source of the eccentric block 40. So the eccentric block 40 is positioned by the pulse shown in FIG. 7, when it is driven to move its location, with the voltage not varying, to brake the resist wheel 40 accurately to attain precise adjusting function. But conventional ones alter voltage to brake, liable to stop not accurately.

Figure 5:
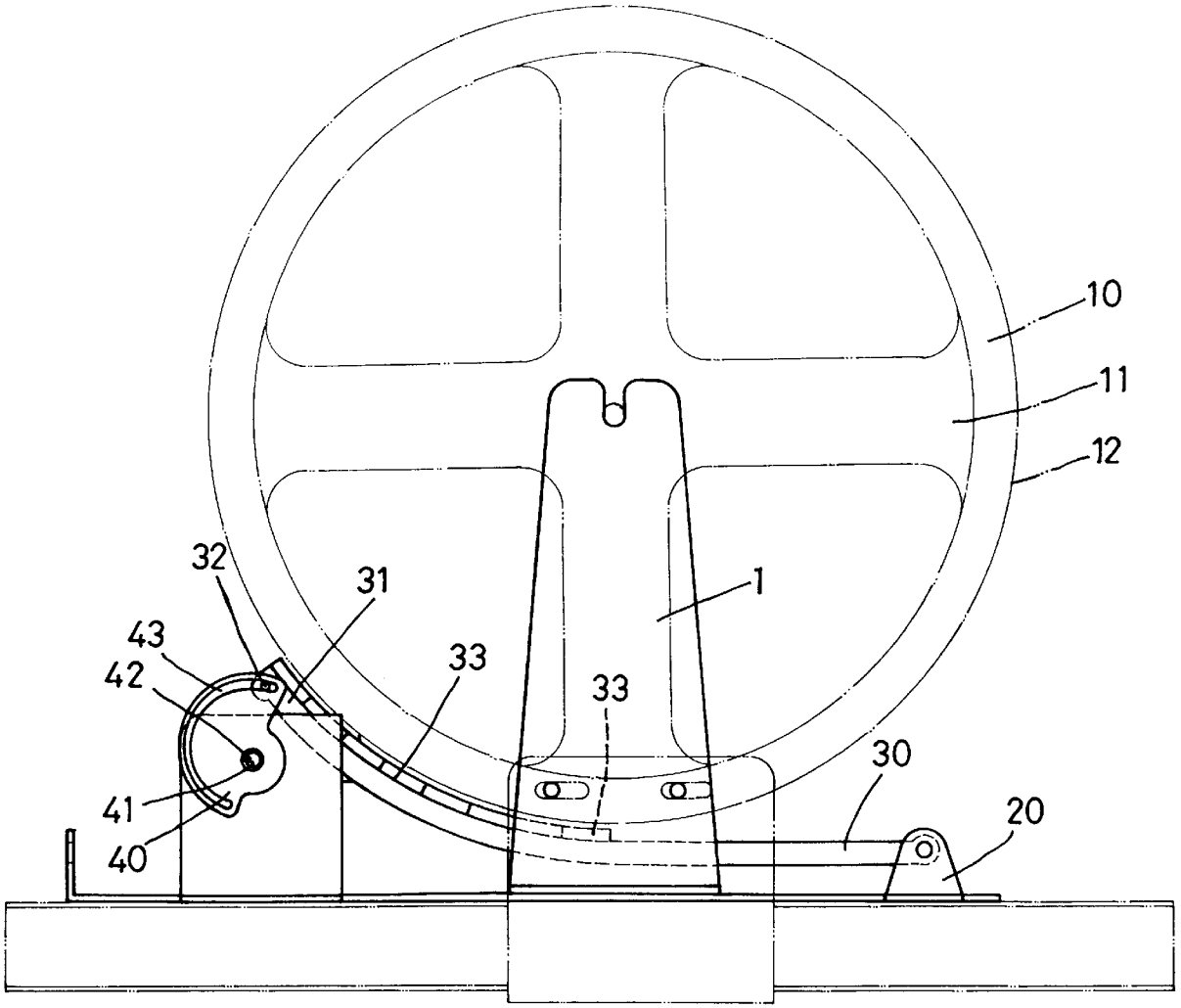
FIG. 5 is a front view of a second embodiment of a resistance control device adjusted to the largest resistance in the present invention.
Figure 6:
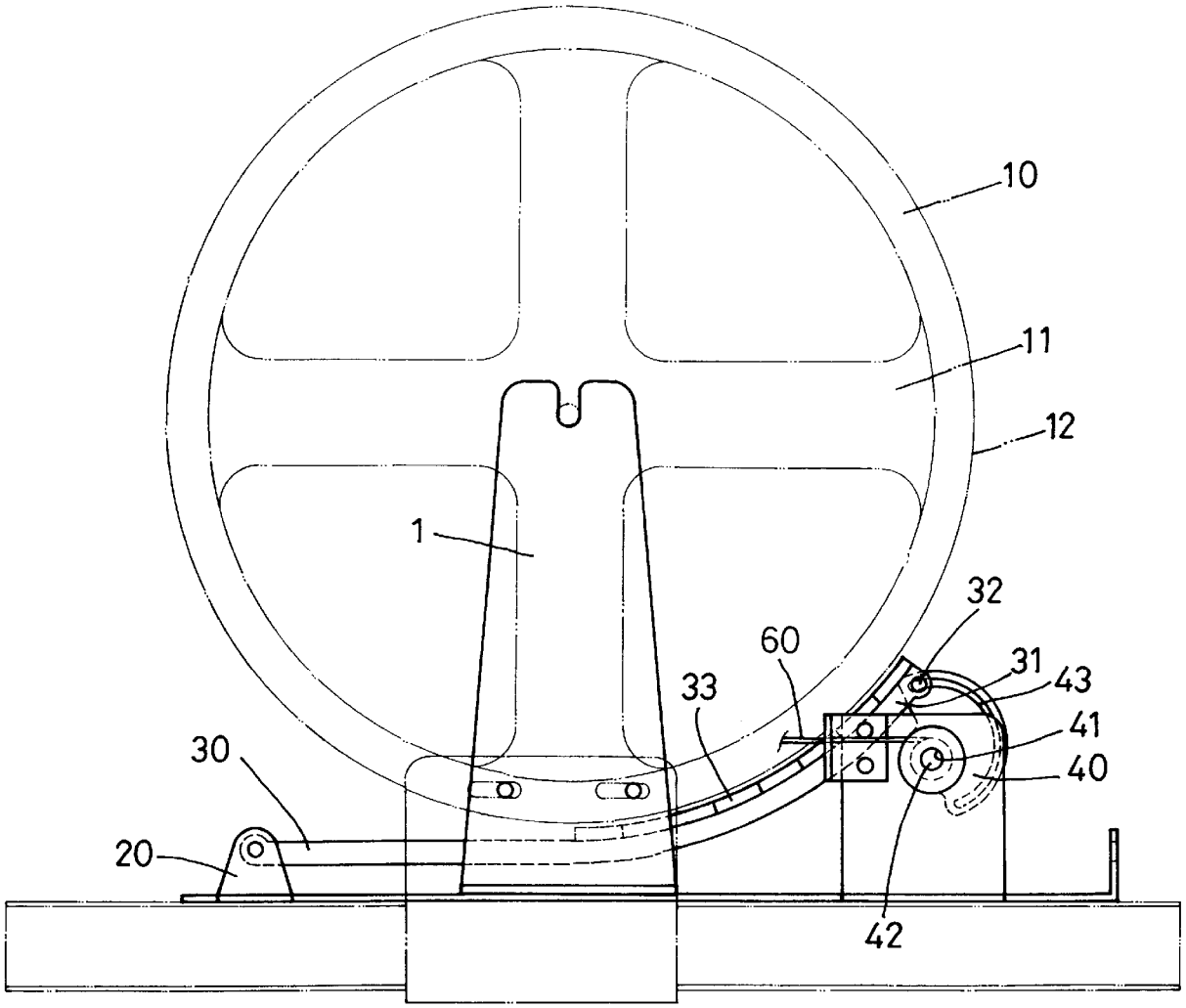
FIG. 6 is a rear view of the second embodiment of a resistance control device adjusted to the largest resistance in the present invention.
Figure 8:
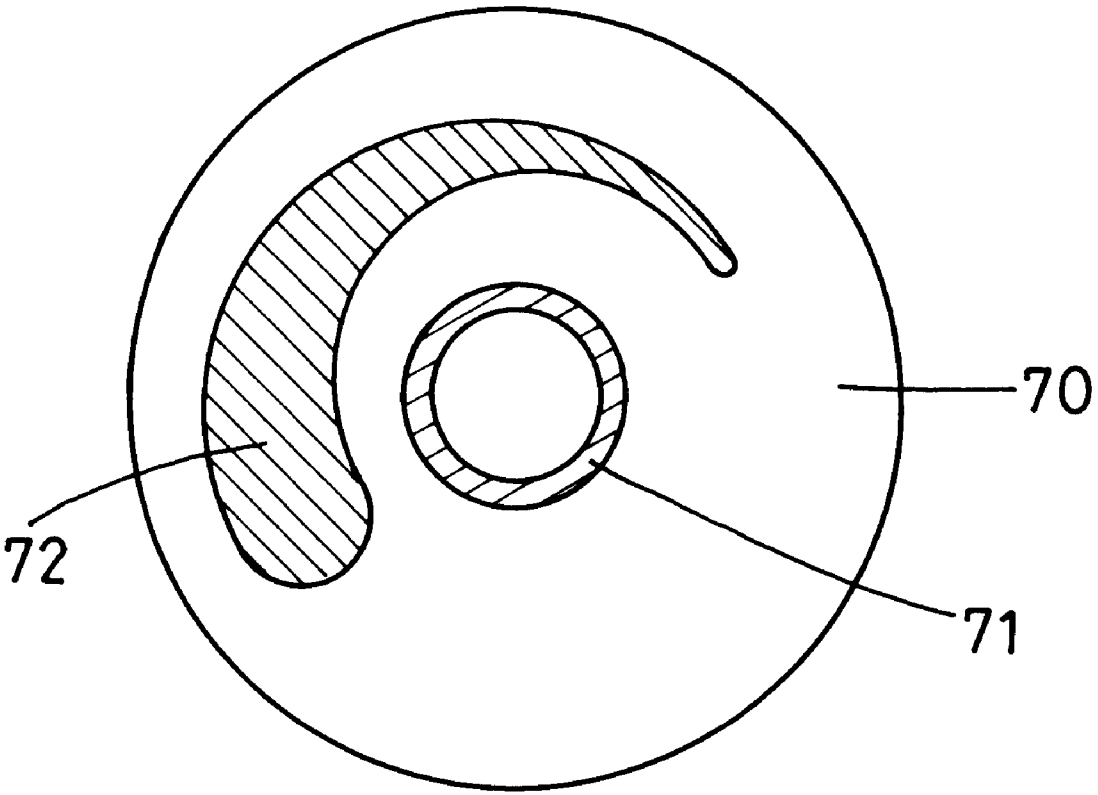

Next, a second embodiment shown in FIGS. 5 and 6, has the same structure as the first one, but the rotatable disc 50 is not used, nor the drive source (the motor) to adjust and control manually, using a wire rope 60 wound around on the center shaft 42 as shown in FIG. 6, controlling slackness or tightness of the wire rope 60 with a button so as to alter the distance between the resist wheel 10 and the magnets 33 to adjust resistance of the resist wheel 10. Further, a variable resistor 70 is added to rotate with the manual button as shown in FIG. 8, and a ring copper conductor 71 is fixed in the center of the variable resistor 70 and a curved plated film resistor 72 of a fat left side growing thinner and thinner to a right side located around the copper conductor 71, Thus when the button with the variable resistor 70 is rotated to alter the resistance and an indicator connected to the variable resistor 70 may show the resistance for the user to see and know how large the resistance is.

It is evident that the components for adjusting the magnet base 30 and the resist wheel 10 are fewer that the conventional ones, with assemblage also simpler to save time and labor. In addition, the distance between every point of the slot 43 and the center shaft hole 41 is decided by the calculating formula, $F=C_3 \times S$, permitting every point in adjusting produce exact resistance value.

While the preferred embodiments of the invention have been described above, it will be recognized and understood that various modifications may be made therein and the appended claims are intended to cover all such modifications which may fall within the spirit and scope of the invention.

Enclosed: A photo copy of a Taiwan Utility Model Application No. 83212071 (Publication No. 254111).

I claim:

1. A resistance control device for a training appliance comprising;

a resist wheel fixed on a frame of a training appliance body, able to be rotated, having the wheel body with a magnetic property and a spherical surface with non-magnetic property;

a fix base fixed with said training appliance below said resist wheel, distanced properly from said spherical surface of said resist wheel;

a magnet base provided to be located between said spherical surface of said resist wheel and said fix base, having a first end pivotally connected to said fix base, a second end being free to move up and down below said spherical surface of said resist wheel, a plurality of magnets arranged in a row on said magnet base facing said spherical surface;

characterized by said free end of said magnet base having a lateral rod, an eccentric block located beside said lateral rod and having a center shaft hole for a a shaft fixed firmly therein, said shaft driven to rotate by a drive source, said eccentric block having a curved long slot for said lateral rod to fit in and move along therein, the distance between every point of said slot and said center shaft hole decided by a calculation formula;

said eccentric block rotated to move said lateral rod along said slot to rise or lower to alter the distance between the magnets of said magnet base and said resist wheel so as to control resistance of said resist wheel against said magnets, facilitating assemblage of said resistance control device and lower its cost, and resistance adjusting being precise because of the distance between every point of said slot and said center shaft hole being decided by calculation formula.

2. The resistance control device for a training appliance as claimed in claim 1, wherein said drive source is a motor with a speed reducer, using a rotatable disc with four notches at the cross position to be rotated by said motor, two units of sensors corresponding to said four notches to send output signals to control said motor driving said rotatable disc, said eccentric block being stopped at the proper position by means of pulses of electricity with voltage not altering, obtaining accurate braking of said resist wheel.

3. The resistance control device as claimed in claim 1, wherein said center shaft of said eccentric block is wound around with a wire rope, which is manually handled to be pulled tense or released loose for adjusting said magnet base.

4. The resistance control device for a training appliance as claimed in claim 3, wherein said manual button is further provided with a variable resistor inside, said variable resistor has a copper conductor in its center, a plated film resistor of a fat left side growing thinner and thinner to a right side around said center conductor, and an indicator connected to said variable resistor, said variable resistor altering its resistor value as said manual button is rotated and letting said indicator indicating the resistor value at the same time to let a user to easily know how large is the resistance is.

* * * * *